US005938434A

United States Patent [19]

Groom

[11] Patent Number: 5,938,434

[45] Date of Patent: Aug. 17, 1999

[54] HEAT INSULATING ARRANGEMENT

[75] Inventor: Bryan Groom, Stoke-on-Trent, United Kingdom

[73] Assignee: Bryan Groom Limited, Staffordshire, United Kingdom

[21] Appl. No.: 08/809,978

[22] PCT Filed: Oct. 10, 1995

[86] PCT No.: PCT/GB95/02396

§ 371 Date: Apr. 2, 1997

§ 102(e) Date: Apr. 2, 1997

[87] PCT Pub. No.: WO96/11371

PCT Pub. Date: Apr. 18, 1996

[30] Foreign Application Priority Data

Nov. 10, 1994 [GB] United Kingdom ..... 9420443

[51] Int. Cl.[6] ..... F27D 3/12

[52] U.S. Cl. ..... 432/241

[58] Field of Search ..... 432/241, 239, 432/253

[56] References Cited

U.S. PATENT DOCUMENTS

| | | | |
|---|---|---|---|
| 1,521,216 | 12/1924 | Dressler | 432/241 |
| 4,300,881 | 11/1981 | Salviati | 432/241 |
| 4,320,612 | 3/1982 | Jeffries, Jr. | 432/241 |

*Primary Examiner*—Teresa J. Walberg
*Assistant Examiner*—Jiping Lu
*Attorney, Agent, or Firm*—Smith-Hill and Bedell

[57] ABSTRACT

A kiln car includes freestanding straight rigid hollow members and freestanding angular rigid hollow members resting on the upper surface of the chassis of the kiln car. The rigid hollow members are of modular configuration and are arranged engaging together around and on the peripheral margin only of the upper surface of the chassis, with the angular members at the corner regions of the peripheral margin and the straight members extending between adjacent angular members. A cover extends over the enclosed area surrounded by the hollow members and there is insulating material within the enclosed area and within the hollow members. Support members for articles being fired extend upward from the upper surface of the chassis through the insulating material to support articles above the cover.

20 Claims, 7 Drawing Sheets

HEAT INSULATING ARRANGEMENT

This invention concerns heat insulating apparatus, and particularly but not exclusively heat insulation apparatus which can be subjected to raised temperatures during firing. The invention also relates to a heat insulation assembly and also to a kiln car.

The use of lightweight insulating materials such as ceramic fibre or foam, or other materials, has greatly increased in recent times in kilns and furnaces, and particularly those used in the ceramics industry. In the firing of ceramic articles it is now common practice to use a continuous kiln on fast firing schedules which is switched off during non-working days and at weekends. This is largely only possible due to the use of such lightweight insulating materials. One of the significant uses of such materials has been as an insulating lining on kiln car chassis, providing a considerable weight saving and thereby providing significant energy savings and permitting faster firing schedules to be used.

Lightweight insulating materials such as ceramic fibres typically have a density of 0.6–1 $gcm^{-3}$. These have replaced conventional hard refractories which have densities typically of 2.1–2.6 $gcm^{-3}$. It is now quite widely considered that such materials may present a health risk. Furthermore, such materials tend to be friable and can therefore provide contamination and dirt during firing, resulting in spoilt product.

According to the present invention there is provided heat insulation apparatus which can be subjected to raised temperatures during firing, the apparatus comprising a rigid hollow member with an interior in which insulating material can be located.

The apparatus preferably comprises a plurality of hollow members engageable together to define an enclosed area in which insulating material can be located. The members may be of modular configuration to permit different sizes and shapes of areas to be enclosed.

The hollow members may be configured to permit an area to be surrounded by a plurality of such members, with cover means locatable over the surrounded area. Formations may be provided on the hollow members to accept the cover means.

The hollow members may comprise a first type which extend substantially linearly, and a second type which form corners. The hollow members preferably have a continuous upper surface, may have an open lower end, and desirably are of a generally inverted U-shaped cross-section. The hollow members preferably have a continuous outer wall but may have openings in an opposite inner wall.

The members are preferably made of a refractory material such as alumina, desirably by casting. For lower temperature situations the members may be made of metal, such as a super alloy.

Projections and/or recesses may be provided on an exterior surface of the hollow members to permit engagement with another component, and/or labyrinth seals to be formed with another component. The members may be configured such that adjacent engaged members partially overlap. Interlocking means may be provided on the hollow members to enable interlocking with adjacent such members. The interlocking means may comprise male and female members.

Formations may be provided on the members for engagement with means for mounting the members on an article or fixture. The formations may comprise flanges or recesses.

The hollow members can be formed to be load bearing.

The invention also provides a heat insulation assembly comprising a plurality of hollow members according to any of the preceding eight paragraphs arranged to define an enclosed area, and an insulating material located in the enclosed area.

The hollow members may be arranged to surround an area with cover means locatable over the surrounded area. Alternatively, the hollow members may provide a substantially continuous surface with the enclosed area being defined wholly by the interior of the hollow members.

The insulating material is preferably of a lower density than the material of the hollow members, and is desirably non-rigid. The insulating material preferably comprises any of loose fill waste ceramic material, foamed ceramic material or ceramic fibre.

Where the hollow members surround an area, the cover means preferably comprises one or more batts.

The assembly may be usable as a floor, wall, ceiling, hearth, lining, cover or lid for a kiln, oven or furnace. Alternatively, the assembly may be usable on a kiln car, perhaps as an insulating lining for the chassis.

The invention still further provides a kiln car comprising a chassis and an insulating lining therefor according to any of the preceding five paragraphs.

The insulating lining preferably comprises a ring of hollow members according to the invention extending around the periphery of the kiln car above the chassis with insulating material within the area bounded by the hollow members, and a cover overlying the insulating material. Insulating material is preferably also provided within the hollow members.

A formation may be provided on the outer surface of the hollow members to accept the frame of the chassis.

The kiln car preferably also comprises support members for articles being fired, the support members extending from the chassis through the insulating material and covers to support articles thereabove.

Embodiments of the present invention will now be described by way of example only with reference to the accompanying drawings, in which.

Figure 1:
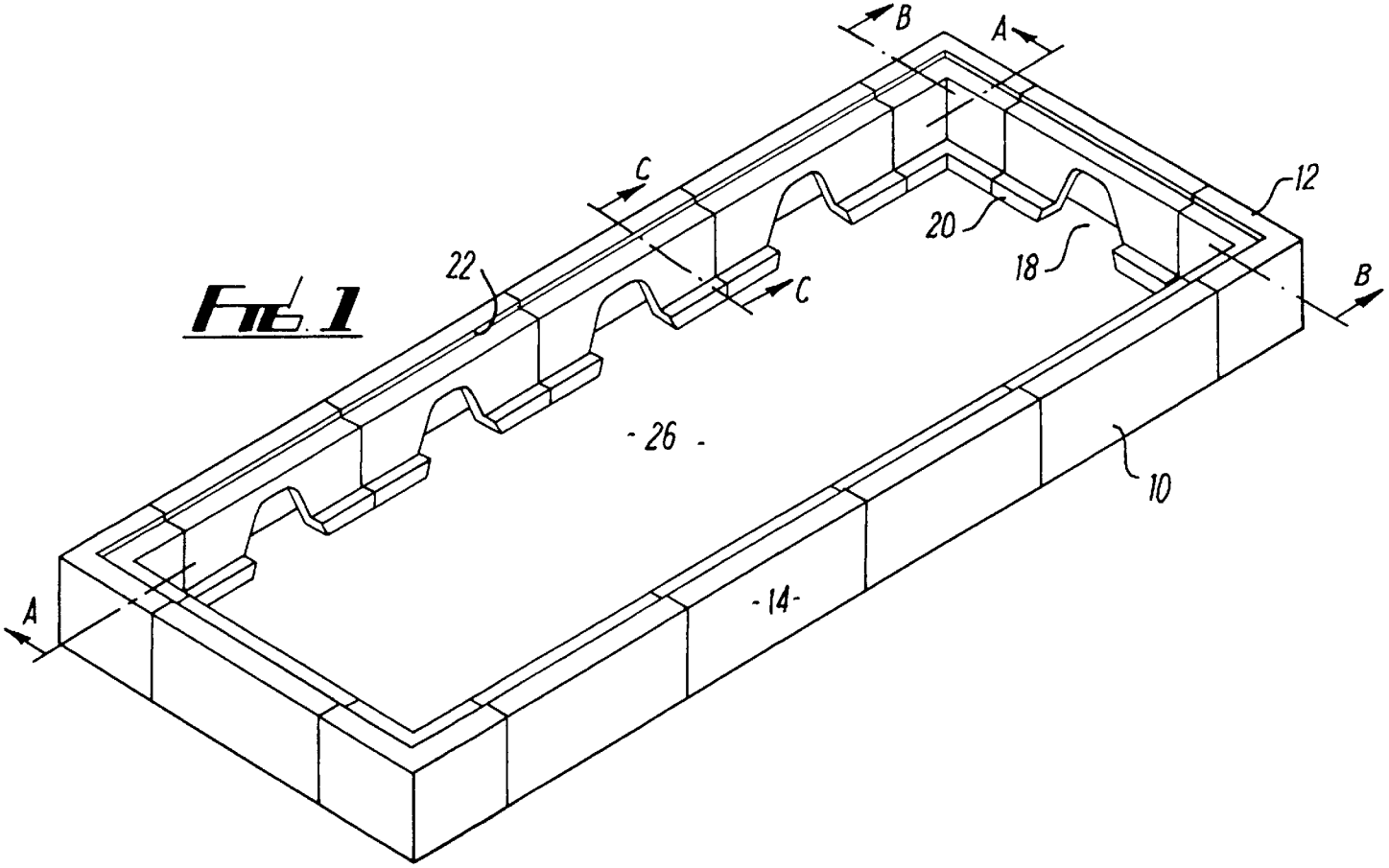
FIG. 1 is a perspective view of a plurality of hollow members according to the invention assembled together.
Figure 2:
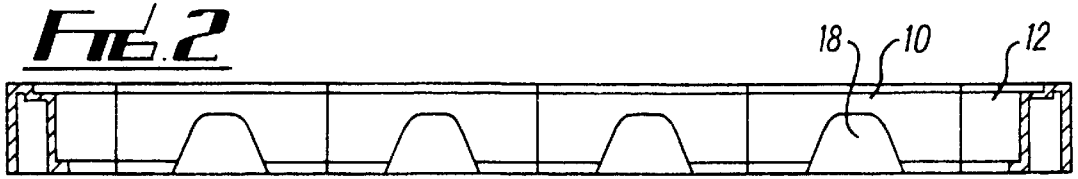
FIG. 2 is a cross-sectional view on the line A—A of FIG. 1.
Figure 3:
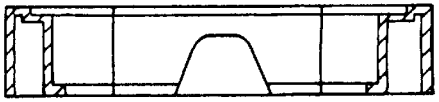
FIG. 3 is a cross-sectional view on the line B—B of FIG. 1.
Figure 4:
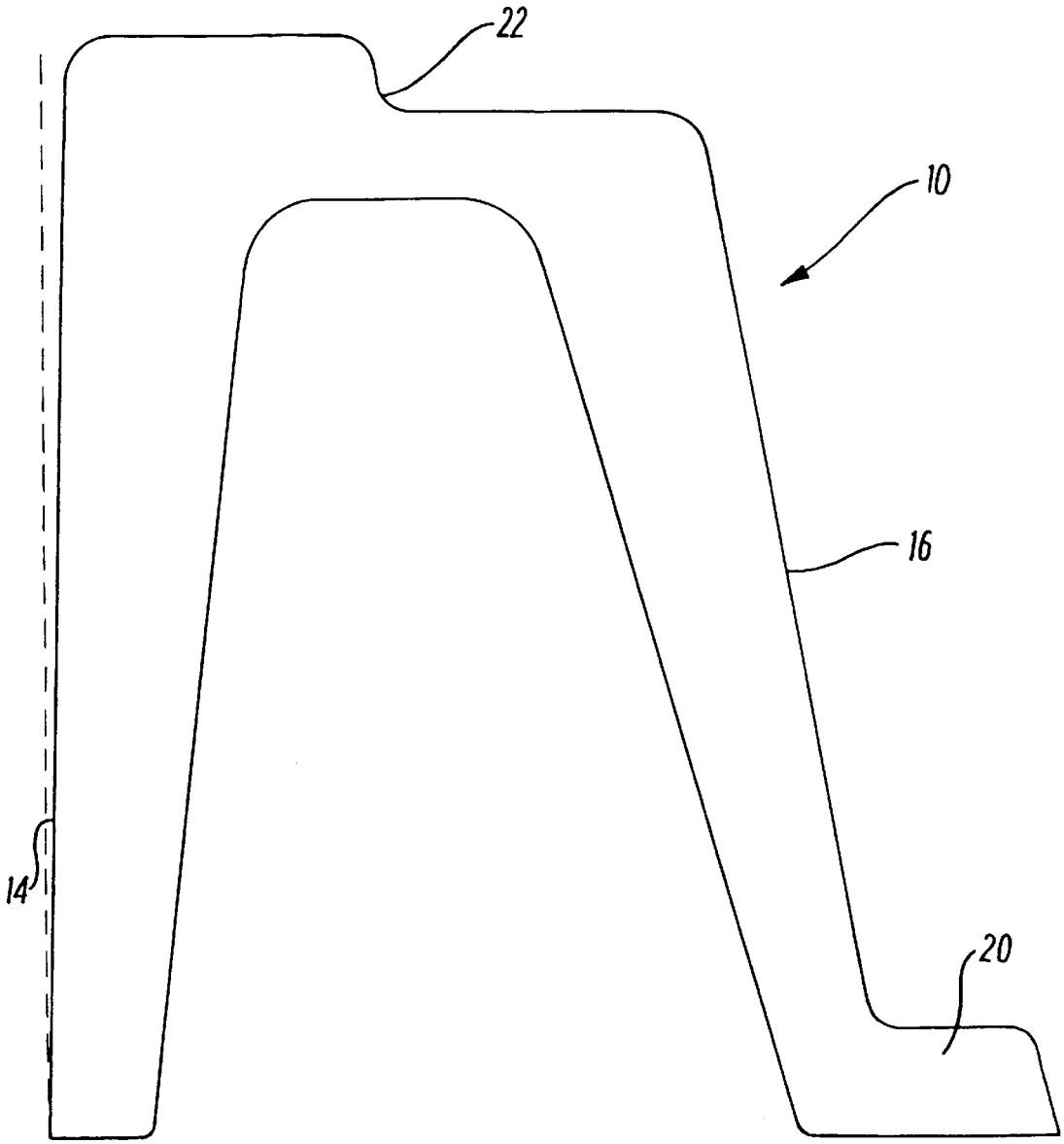
FIG. 4 is a cross-sectional view on the line C—C of FIG. 1.

FIG. 1 shows a plurality of hollow members 10,12 according to the present invention. The members comprise two types, a linear type 10 and a corner type 12. Both types of members 10,12 have the same cross-section, see FIG. 4, but the corner type 12 has two sections extending perpendicularly from each other to define a corner. The members 10,12 are hollow and of generally an inverted U-shaped cross-section. One side of the members provides a continuous outer face 14. The opposite inner side provides an inner face 16 and cut-outs 18 are provided in the inner side on the linear members 10. A foot 20 is provided on the base of the inner side 16 pointing away from the face 14. The upper surface of the members 10,12 has a downward step 22 substantially centrally thereof extending downwardly on the inner face side. The faces 14,16 are inclined slightly inwardly relative to the vertical.

The members 10,12 in this example are formed from alumina by casting. An inner step 24 may be provided on the outer face 14 as is disclosed in FIGS. 5–7, for a purpose hereinafter to be described.

The members 10,12 can be arranged abutting one another to define a rectangular border as in FIG. 1, surrounding an inner area 26. The area 26 and also the interiors of the members 10,12 can be filled with a non-rigid heat insulating material such as ceramic fibre. Batts can be provided to cover the area 16 with the edges of the batts engaging in the step 22. This arrangement provides a heat insulation assembly which can be used for a number of purposes. For example such an assembly may be used to line a kiln, oven or furnace.

Figure 5:
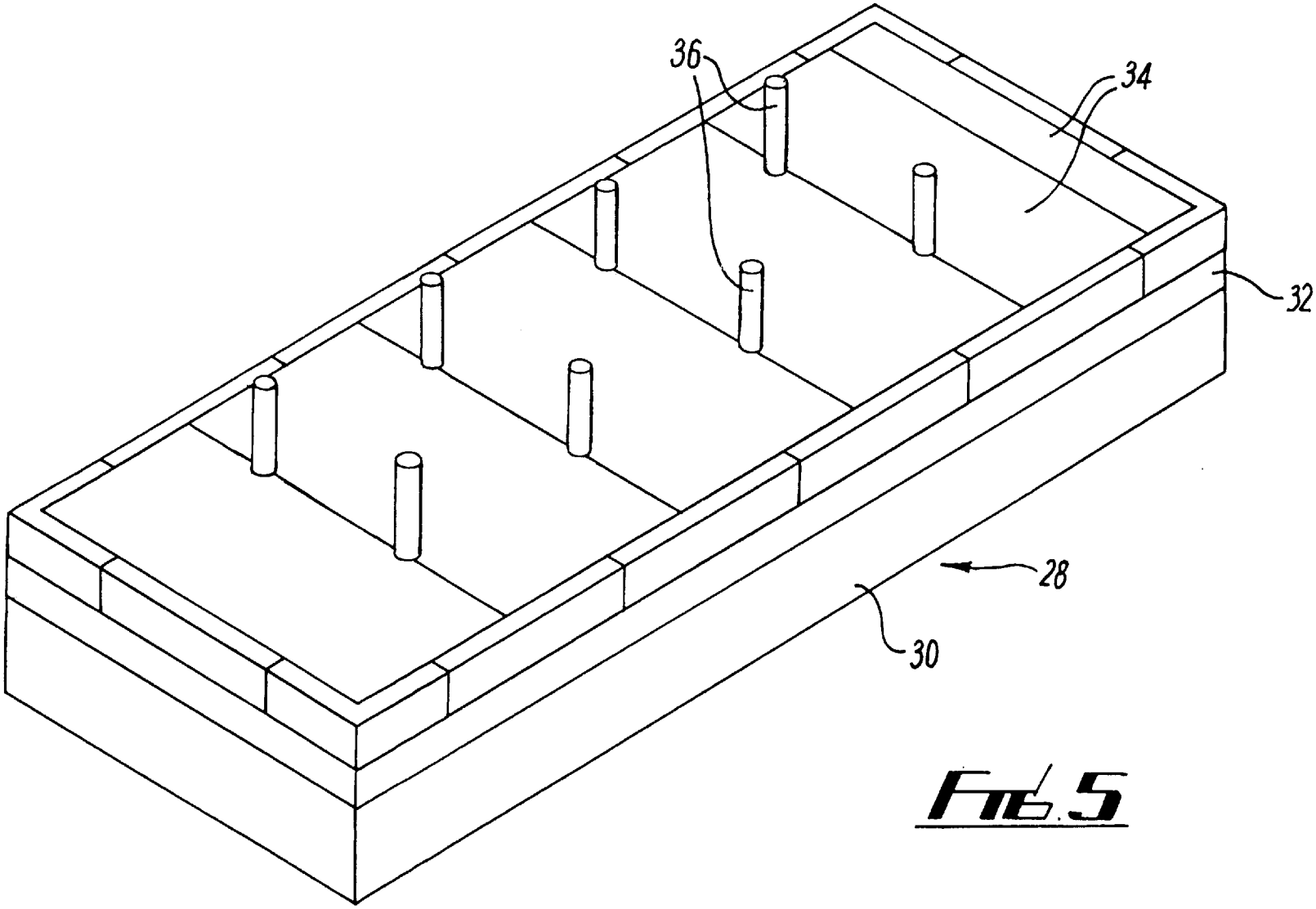
FIG. 5 is a diagrammatic perspective view of a kiln car according to the present invention.

FIG. 5 shows such an assembly being used on a kiln car 28 to protect the chassis 30 and wheel arrangement (not shown). In this embodiment a metal strip 32 extends around the periphery of the upper surface of the chassis 30, and the strip 32 is engageable in the step 24. Ceramic fibre is provided in the area enclosed by the members 10,12 and also within the interior of these members. Batts 34 extend between the members 10,12 on opposite sides of the car 28 and with their edges engageable in the steps 22. A plurality of elongate support members 36 extend from the chassis 30 through the ceramic fibre and batts 34. Any appropriate support arrangement may be provided on the upper ends of the members 36, such as a framework of refractory beams etc., to support the ceramic ware being fired. Appropriate recesses are provided on the edges of the batts 34 to accept the members 36 such that the members 36 extend through joints between adjacent batts 34.

There is thus described a kiln car, and particularly the heat insulation assembly for the chassis of the kiln car, which provides considerable advantages. The enclosure of the ceramic fibre or other insulating material used provides for a clean and essentially dust free arrangement, therefore reducing the possibility of products being spoilt. The arrangement is easy to clean and the modular arrangement permits any damaged components to be replaced. The assembly is also of a relatively low mass thereby providing energy savings whilst also achieving the above advantages.

In general terms the modular nature of the hollow members permits different shapes and sizes of assemblies to be formed. As the members are hollow high thermal gradients can be accepted and thermal shock is reduced. The members are therefore readily suited for use in fast firing situations.

Figure 6:
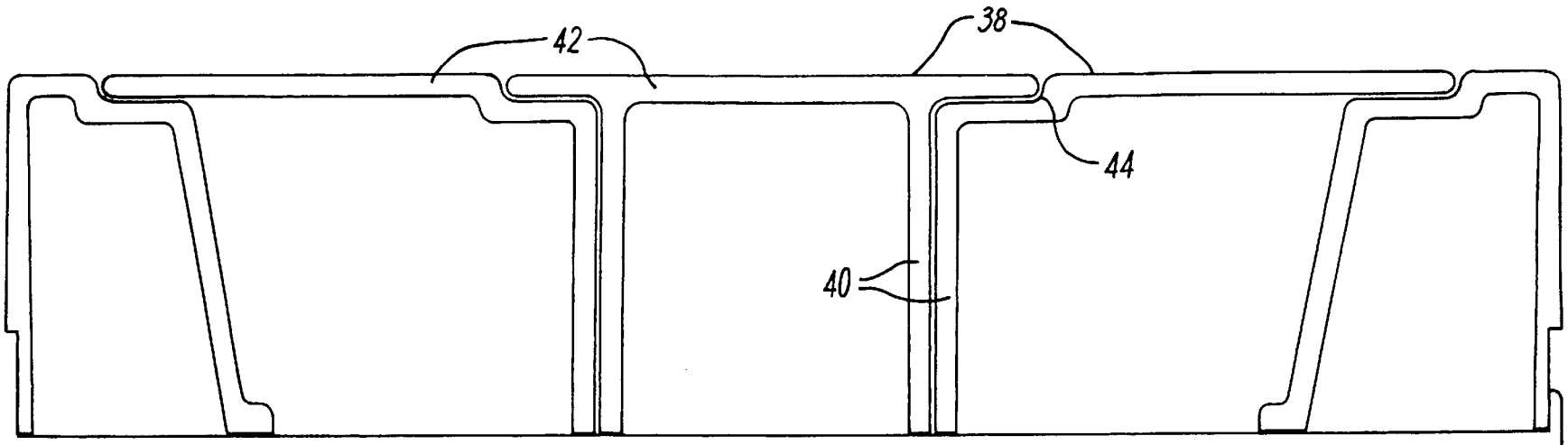
FIG. 6 is a diagrammatic cross-sectional view of a further embodiment of the invention.
Figure 7:
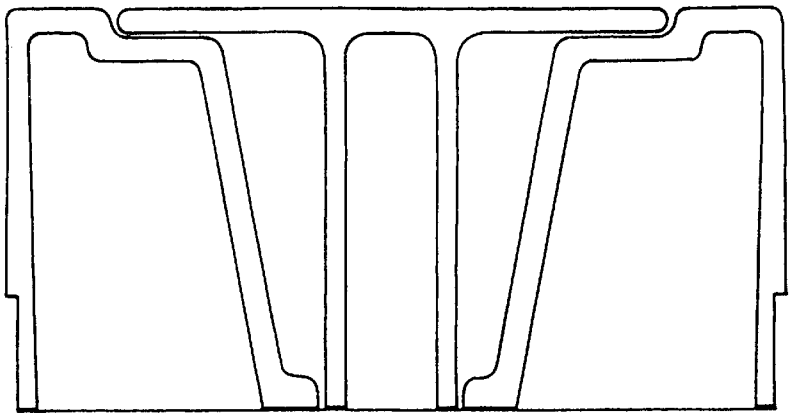
FIG. 7 is a diagrammatic cross-sectional view of a still further embodiment according to the invention.

FIGS. 6 and 7 show diagrammatically two heat insulation assemblies which are load bearing. The assemblies again incorporate hollow members 10, and further hollow members 38 are provided which have downwardly extending members 40 and laterally extending members 42. Steps 44 may be provided on some of the members 38 to accept overlapping formations 42, in a similar manner to the steps 22. These heat insulation assemblies could be usable for example as the floor of a kiln, oven or furnace, or in other panels where extra strength is required.

Figure 8:
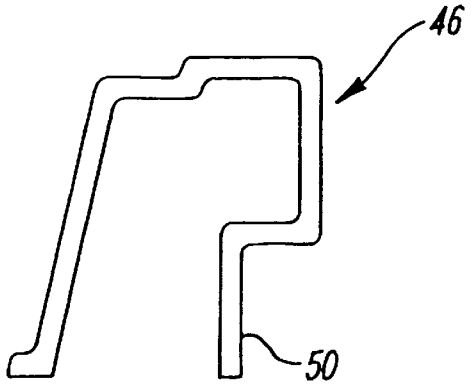
FIGS. 8–11 are similar views to FIG. 4 of further hollow members according to the invention.
Figure 9:
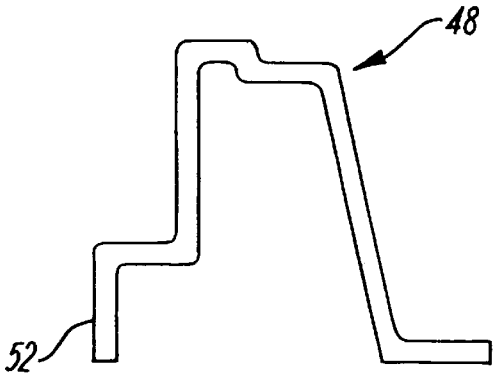

FIGS. 8 and 9 show hollow members 46,48 suitable for use at for instance respective ends of a kiln car. An inward step 50 is provided in the outer face of the member 46. A corresponding outward step 52 is provided in the outer face of the member 48. Accordingly, when the members 46,48 are provided on opposite ends of adjacent kiln cars and when the cars abut, the step 52 will engage in the step 50 to provide a labyrinth heat seal between the floor of the kiln and the heated area.

Figure 10:
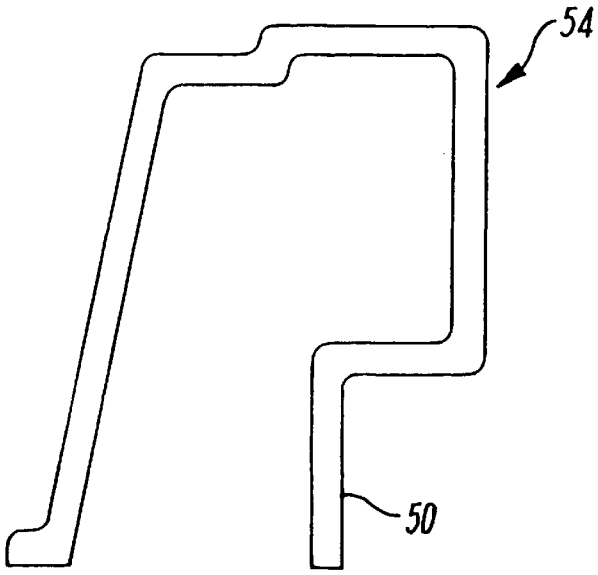
Figure 11:
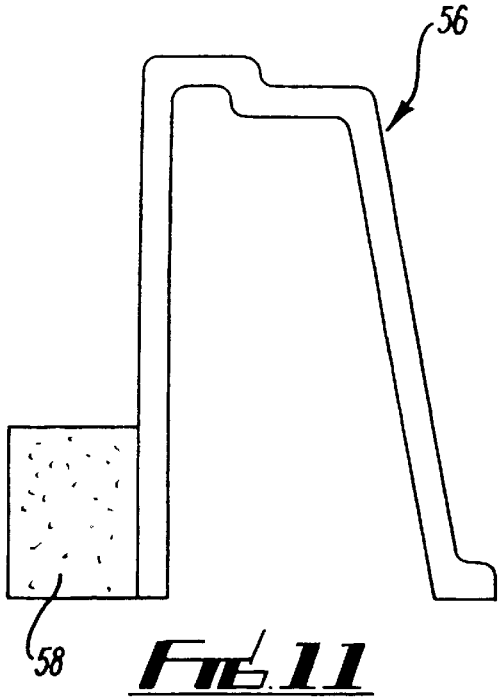

FIGS. 10 and 11 show a similar arrangement with hollow members 54 and 56. The member 54 is similar to the member 46 with an inward step 50. No outer step is provided on the member 56 but rather an insulation brick 58 is provided of a corresponding shape and size to engage in the step 50. It is to be realised that a plurality of such bricks 58 would be provided along a respective end of a kiln car.

Figure 12:
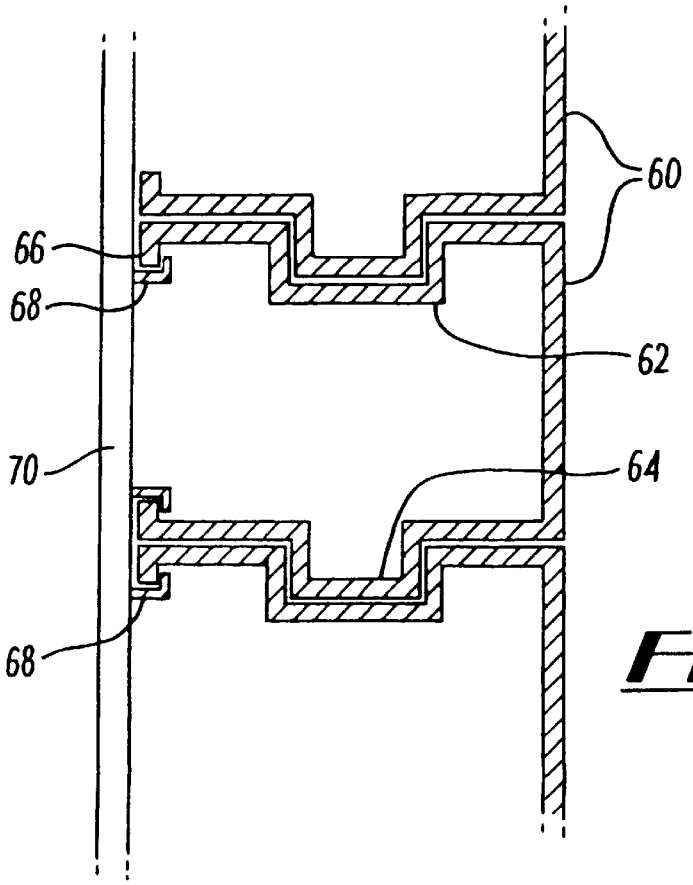
FIG. 12 is a diagrammatic cross-sectional view of another embodiment according to the invention.

FIG. 12 shows use of hollow members 60 according to the invention providing an insulating side wall for a kiln. The members 60 are of substantially regular inverted U-shaped cross-section except that a recess 62 is provided on one side limb of the U and a corresponding projection 64 is provided on the opposite side of the U. When stacked together the projections 64 engage in the recesses in adjacent members 60, thereby providing a labyrinth seal. The free ends of the limbs of the U are turned inwardly to define flanges 66. Steel retaining clips or lengths of angle iron 68 are provided on a steel framework 70 on the outer side of the kiln to mount the members 60 thereto.

Figure 13:
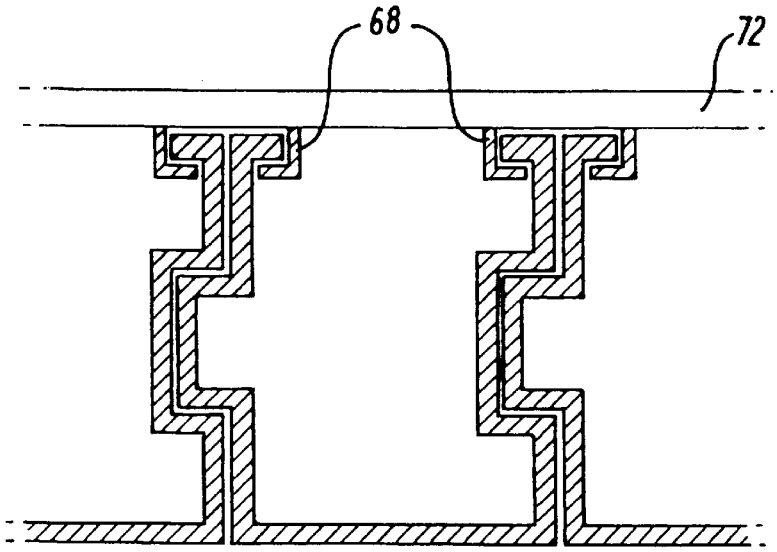
FIG. 13 is a diagrammatic cross-sectional view of yet another embodiment according to the invention.

FIG. 13 shows a similar arrangement to FIG. 12 but for providing a roof for a kiln. Here the clips or lengths of angle iron 68 project downwardly from a steel girder 72.

Figure 14:
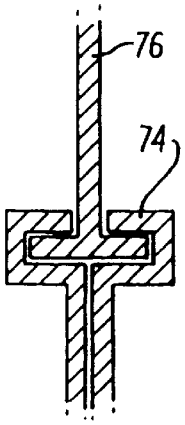
FIG. 14 is a diagrammatic cross-sectional view of part of an alternative arrangement to FIG. 10.

FIG. 14 shows an alternative arrangement for mounting hollow members. In this arrangement the inwardly turned bases of the hollow members provide an outwardly facing recess 74 engageable around the cross-member of an inverted T-shaped support 76. Where a pair of hollow members are provided adjacent each other as shown in FIG. 14 this provides a very secure mounting on the support 76. The support may be made of a refractory material or metal.

Figure 15:
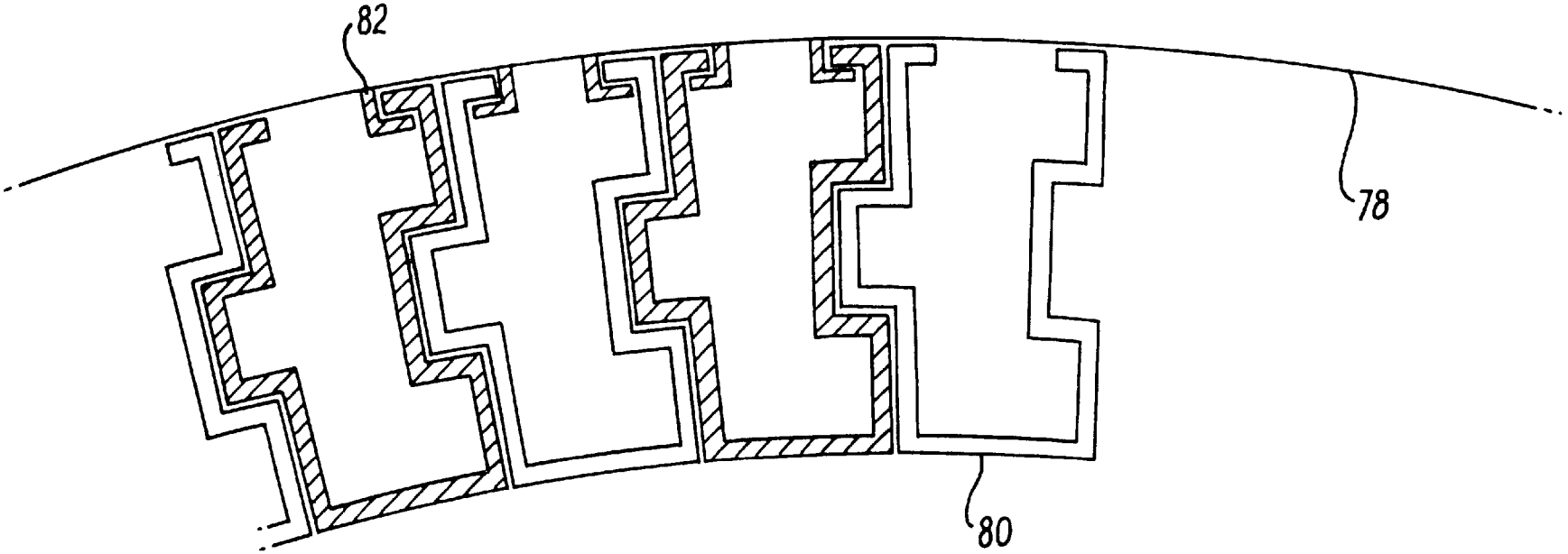
FIG. 15 is a diagrammatic cross-sectional view of a yet further embodiment according to the invention.

FIG. 15 shows a generally similar arrangement to FIG. 13 for providing an insulating roof lining for a kiln. In this instance an arch roof 78 is provided. The hollow members 80 may be provided so as to converge slightly towards their closed end or alternatively the spaces between the members 80 could narrow towards the closed end of the members 80. As an alternative to providing an arch roof behind the members 80, a roof girder (not shown) could be provided with retaining clips 82 as shown, with the clips 82 towards the centre of the kiln being shorter than those towards the side walls thereby providing the arched roof.

Various other modifications may be made without departing from the scope of the invention. For example, the hollow members may be made of other materials and/or by other methods. A wide range of refractory materials could be used in their construction, or for lower temperature applications the members could be made of metal such as for example super alloys. The hollow members may be differently configured. For instance on a kiln car one or more projections may be provided engageable in corresponding recesses in the kiln wall, or vice versa.

Engagement means may be provided on the hollow members to permit engagement with adjacent members. The engagement means may be respectively male and female. As illustrated in FIGS. 6 and 7, the hollow members may be formed so as to overlap with each other.

The insulating material can be other than ceramic fibre and could comprise any of loose fill waste ceramic material, foamed ceramic material or other suitable materials. Cover means other than batts could be used to cover an enclosed area. Apparatus according to the invention is usable in a wide range of applications a number of which have been illustrated and can be used in a floor, wall, ceiling, hearth, lining, cover or lid, for a kiln, oven or furnace. As well as kiln cars the apparatus could be used on bogies in furnaces and other similar applications.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A kiln car comprising:

a chassis having a generally rectangular upper surface with a peripheral margin, the peripheral margin having corner regions joined by side regions, an insulating lining on the upper surface of the chassis, the lining comprising a plurality of freestanding straight rigid hollow members of generally inverted U-shaped cross-section with side walls and an upper wall and a plurality of freestanding angular rigid hollow members each comprising first and second segments of generally inverted U-shaped cross-section with side walls and an upper wall, said rigid hollow members being of modular configuration and arranged engaging together around and on the peripheral margin only of the upper surface of the chassis, with the angular members at the corner regions of the peripheral margin and the straight members extending between adjacent corner members, whereby the rigid hollow members define an enclosed area, a cover extending over the enclosed area, and insulating material within the enclosed area and within the hollow members, and a support structure for supporting articles being fired, the support structure extending upward from the upper surface of the chassis through the insulating material to support articles above the cover.

2. A kiln car according to claim 1, wherein the hollow members are provided with formations engaging the cover.

3. A kiln car according to claim 1, wherein the upper walls of the hollow members each have an inner portion and an outer portion, the inner portion is recessed below an outer portion, and the cover is fitted in the recess formed by the inner portions of the hollow members and is flush with the outer portions of the hollow members.

4. A kiln car according to claim 1, wherein each straight hollow member has an outer side wall and an inner side wall and each segment of each angular hollow member has an outer side wall and an inner side wall, and each outer side wall is substantially continuous.

5. A kiln car according to claim 1, wherein each straight hollow member has an outer side wall and an inner side wall and each segment of each angular hollow member has an outer side wall and an inner side wall, and each inner side wall is formed with at least one opening.

6. A kiln car according to claim 1, wherein each straight hollow member has an outer side wall and an inner side wall and each segment of each angular hollow member has an outer side wall and an inner side wall, and each inner side wall is provided with an inwardly facing foot.

7. A kiln car according to claim 1, wherein the hollow members are made of a refractory material.

8. A kiln car according to claim 7, wherein the hollow members are made by casting.

9. A kiln car according to claim 1, wherein the hollow members are made of metal.

10. A kiln car according to claim 1, wherein projections are provided on an exterior surface of at least one hollow member and a corresponding recess is provided on an exterior surface of another hollow member.

11. A kiln car according to claim 1, wherein at least one hollow member partially overlaps an adjacent hollow member.

12. A kiln car according to claim 1, wherein the hollow members and the chassis have respective formations for locating the hollow members on the chassis.

13. A kiln car according to claim 12, wherein the formations of the hollow members are recesses and the formation of the chassis is a flange which extends around the upper surface of the chassis.

14. A kiln car according to claim 1, wherein the cover comprises one or more batts.

15. A kiln car according to claim 1, wherein the insulating material is of a lower density than the material of the hollow members.

16. A kiln car according to claim 1, wherein the insulating material is non-rigid.

17. A kiln car according to claim 1, wherein the insulating material is loose fill waste ceramic material, foam ceramic material or ceramic fiber.

18. A kiln car according to claim 1, wherein the support structure comprises a plurality of support members.

19. A kiln car according to claim 18, wherein the support members are elongate members extending upward from the chassis and projecting above the cover for supporting articles.

20. A kiln car according to claim 19, wherein the cover comprises a plurality of batts and the support members extend through joints between adjacent batts.

* * * * *